US011300323B2

(12) United States Patent
Deivasigamani et al.

(10) Patent No.: US 11,300,323 B2
(45) Date of Patent: Apr. 12, 2022

(54) HEATING SYSTEM ENCLOSURE

(71) Applicant: Intellihot, Inc., Galesburg, IL (US)

(72) Inventors: Sridhar Deivasigamani, Peoria, IL (US); Sivaprasad Akasam, Dunlap, IL (US)

(73) Assignee: Intellihot, Inc., Galesburg, IL (US)

( * ) Notice: Subject to any disclaimer, the term of this patent is extended or adjusted under 35 U.S.C. 154(b) by 0 days.

(21) Appl. No.: 16/731,554

(22) Filed: Dec. 31, 2019

(65) Prior Publication Data

US 2021/0199341 A1 Jul. 1, 2021

(51) Int. Cl.
*F24H 9/02* (2006.01)

(52) U.S. Cl.
CPC ..... *F24H 9/02* (2013.01)

(58) Field of Classification Search
CPC ..... B67D 1/0884; B67D 1/0895; F22B 37/36; F24D 17/00; F24D 17/0078; F24D 19/0097; F24H 1/08; F24H 9/02; F24H 9/06; F25D 23/02; H01R 13/447; H02G 3/22
USPC ..... 122/19.2
See application file for complete search history.

(56) References Cited

U.S. PATENT DOCUMENTS 2,463,250 A * 3/1949 Curtiss, Jr. ..... F25D 23/021 49/317
4,725,107 A * 2/1988 Appleton ..... F25D 11/02 312/283
5,020,512 A * 6/1991 Vago ..... F23J 13/025 122/156
5,097,801 A * 3/1992 Burns ..... F24D 12/02 122/20 B
5,415,133 A * 5/1995 Noh ..... F24H 1/28 122/13.01
6,198,046 B1 * 3/2001 Moodie ..... H01R 13/6395 174/67
6,951,191 B1 * 10/2005 Lin ..... F24H 1/145 122/13.01
8,851,022 B2 * 10/2014 Jacques ..... F24H 9/148 122/19.2
9,270,098 B2 * 2/2016 Isaacks ..... H02G 3/08
10,344,661 B2 * 7/2019 Ikeda ..... F02B 63/044
10,563,925 B2 * 2/2020 Sakaray ..... F28D 1/05366
2004/0008483 A1 * 1/2004 Cheon ..... G06F 1/20 361/679.53
2006/0118279 A1 * 6/2006 Stafford ..... H01L 23/473 165/104.33

(Continued)

*Primary Examiner* — Nathaniel Herzfeld
(74) *Attorney, Agent, or Firm* — Tracy Jong Law Firm; Tracy P. Jong; Cheng Ning Jong

(57) ABSTRACT

An enclosure for a water heating system for a service selected from the group consisting of receiving water through a water inlet port, recirculating water through a recirculation port, outputting a heated water supply through a water outlet port, receiving a gas supply through a gas inlet port, receiving an air supply through an air inlet port and a combustion exhaust through an exhaust port, the enclosure including a wall through which at least one of the water inlet port, the recirculation port, the water outlet port, the gas inlet port, the air inlet port and the exhaust port is disposed, the wall is configured to be removable for access to equipment disposed inside the enclosure, the equipment is connected to the at least one of the water inlet port, the recirculation port, the water outlet port, the gas inlet port, the air inlet port and the exhaust port.

2 Claims, 6 Drawing Sheets

(56) References Cited

U.S. PATENT DOCUMENTS

| | | | | |
|---|---|---|---|---|
| 2007/0047203 | A1* | 3/2007 | Chen | G06F 1/20 361/698 |
| 2012/0192813 | A1* | 8/2012 | Evans | F23N 5/00 122/20 B |
| 2012/0193375 | A1* | 8/2012 | Forte | B67D 1/1231 222/146.1 |
| 2015/0241085 | A1* | 8/2015 | Justus | F24H 9/148 290/2 |
| 2018/0363925 | A1* | 12/2018 | Deivasigamani | F24D 17/0026 |
| 2019/0093942 | A1* | 3/2019 | Scalf | B67D 3/0003 |

* cited by examiner

HEATING SYSTEM ENCLOSURE

BACKGROUND OF THE INVENTION

1. The Field of the Invention

The present invention relates to a heating system enclosure which allows selective access while offering protection while access is not needed. More specifically, the present invention is directed to a heating system enclosure having a removable covering which protects the heating system disposed within the enclosure while allowing access to the heating system from a direction where a service can be adequately provided.

2. Background Art

In a heating system, an enclosure is typically used to control access to the heating unit/s and the peripheral devices used for controlling the heating units while the enclosure is useful for protecting the heating units from intrusions and tampering. Access to service interfaces, e.g., water inlet/outlet/recirculation ports and gas inlet/outlet ports, etc., is typically limited as fixed walls, coverings or surfaces are disposed around these interfaces to protect them and devices disposed within these walls. However, with walls around such interfaces, access to the interior of the enclosure that houses the heating units and their peripheral devices is severely reduced. Confined by limited access and space, service personnel may not properly diagnose problems related to the heating units or they can take significantly longer to accomplish maintenance and/or corrective actions, e.g., replacing heating units or their components and peripheral devices.

There exists a need for an enclosure that provides selective access to its interior around service interfaces of the enclosure.

SUMMARY OF THE INVENTION

In accordance with the present invention, there is further provided an enclosure for a water heating system for a service selected from the group consisting of receiving water through a water inlet port, recirculating water through a recirculation port, outputting a heated water supply through a water outlet port, receiving a gas supply through a gas inlet port, receiving an air supply through an air inlet port and a combustion exhaust through an exhaust port, the enclosure including a wall through which at least one of the water inlet port, the recirculation port, the water outlet port, the gas inlet port, the air inlet port and the exhaust port is disposed, the wall is configured to be removable for access to equipment disposed inside the enclosure, the equipment is connected to the at least one of the water inlet port, the recirculation port, the water outlet port, the gas inlet port, the air inlet port and the exhaust port.

In one embodiment, the wall includes at least one door. In one embodiment, the wall includes at least one door configured to be openable while the service is in use. In one embodiment, the wall includes at least one hinged door. In one embodiment, the wall includes at least one hinged door configured to be openable while the service is in use. In one embodiment, the enclosure further includes a front surface, wherein the wall is disposed on the front surface. In one embodiment, the enclosure further includes a side surface, wherein the wall is disposed on the side surface. In one embodiment, the wall includes at least one sliding door.

An object of the present invention is to provide a heating system having a protective enclosure having openable walls that provide access to the interior of the enclosure at service interface locations.

Another object of the present invention is to provide a heating system configured for a direct drop-in replacement of a heating system having fluid conductors that are already plumbed from or near the floor or ceiling of a space in which the water heating system is located.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—enclosure
4—recirculation port
6—water inlet port
8—front surface or wall of enclosure
10—floor
12—recirculation conductor
14—cold water supply conductor
16—temperature sensor
18—relief valve port

20—hot water outlet port
22—power supply inlet port
24—exhaust outlet port
26—fresh air intake port
28—fuel supply port
30—controller
32—upper door
34—lower left door
36—lower right door
38—water inlet port
40—heating unit
42—heating unit
44—user interface
46—front surface
48—hinge
50—cutout
52—water supply conductor
54—magnetic latch
56—lip
58—side surface or wall of enclosure
60—rail or track

PARTICULAR ADVANTAGES OF THE INVENTION

The present invention is directed to a heating system having a protective enclosure having openable walls that provide access to the interior of the enclosure at service interface locations. Therefore, on one hand, the heating system is protected within an enclosure and services into and out of the heating system such as a cold water line, a recirculation line and a heated water line, etc., can be extended into and received from the heating system via the enclosure, the interface of these services is fully serviceable as the enclosure is removable at this interface. In one embodiment, the present interface includes two doors that can be opened around the services, e.g., water and/or gas services, etc., for access and closed when such access is no longer needed. In addition to affording convenience for servicing the equipment inside the enclosure, the present enclosure also enhances the availability of a service personnel of the heating system in troubleshooting any known or yet to be discovered operational problems of the heating system as the service personnel has increased access to the interior of the enclosure that houses the heating system while the heating system is operational.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
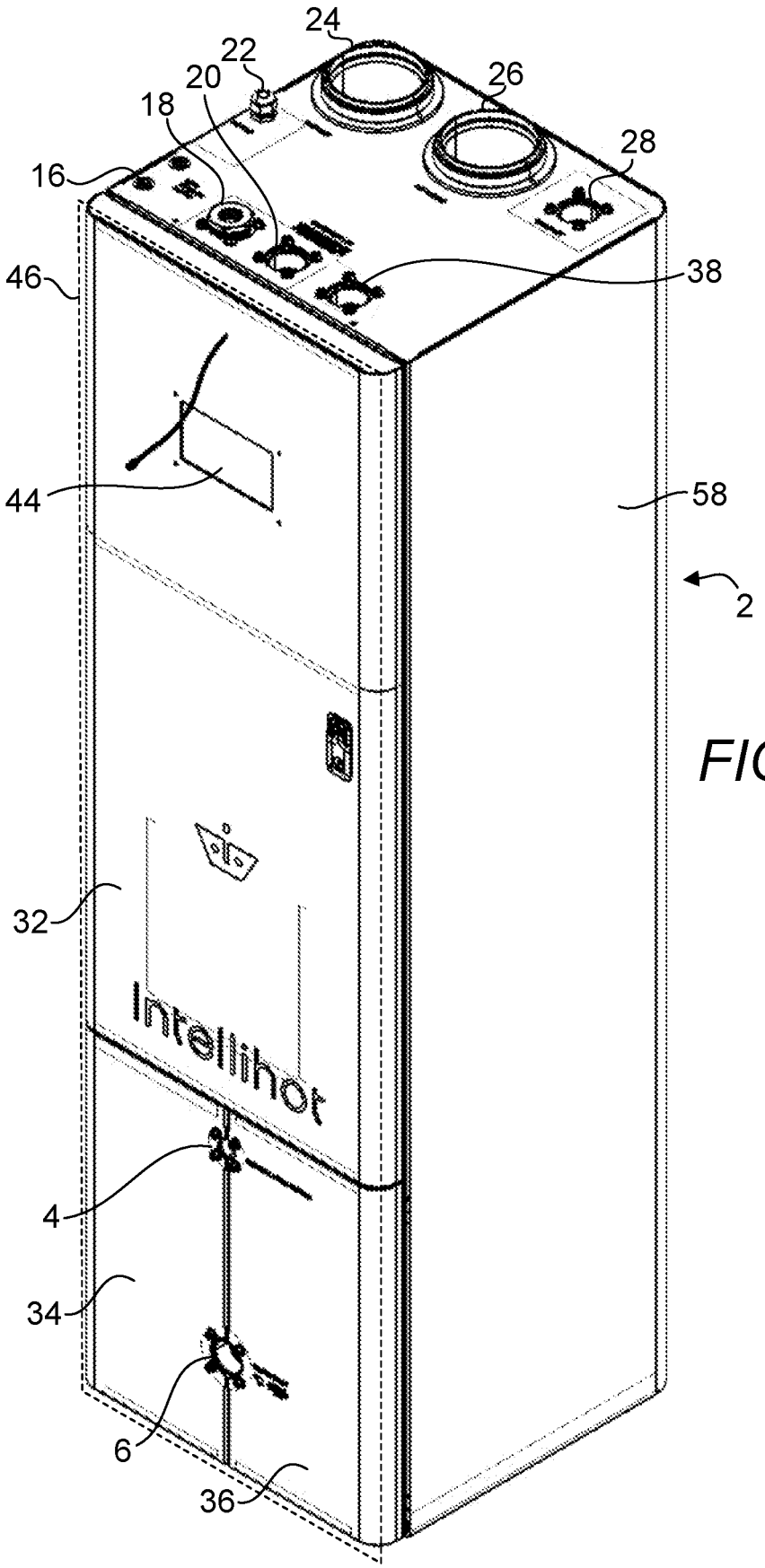
FIG. 1 is a front perspective view of an enclosure of a heating system.
Figure 2:
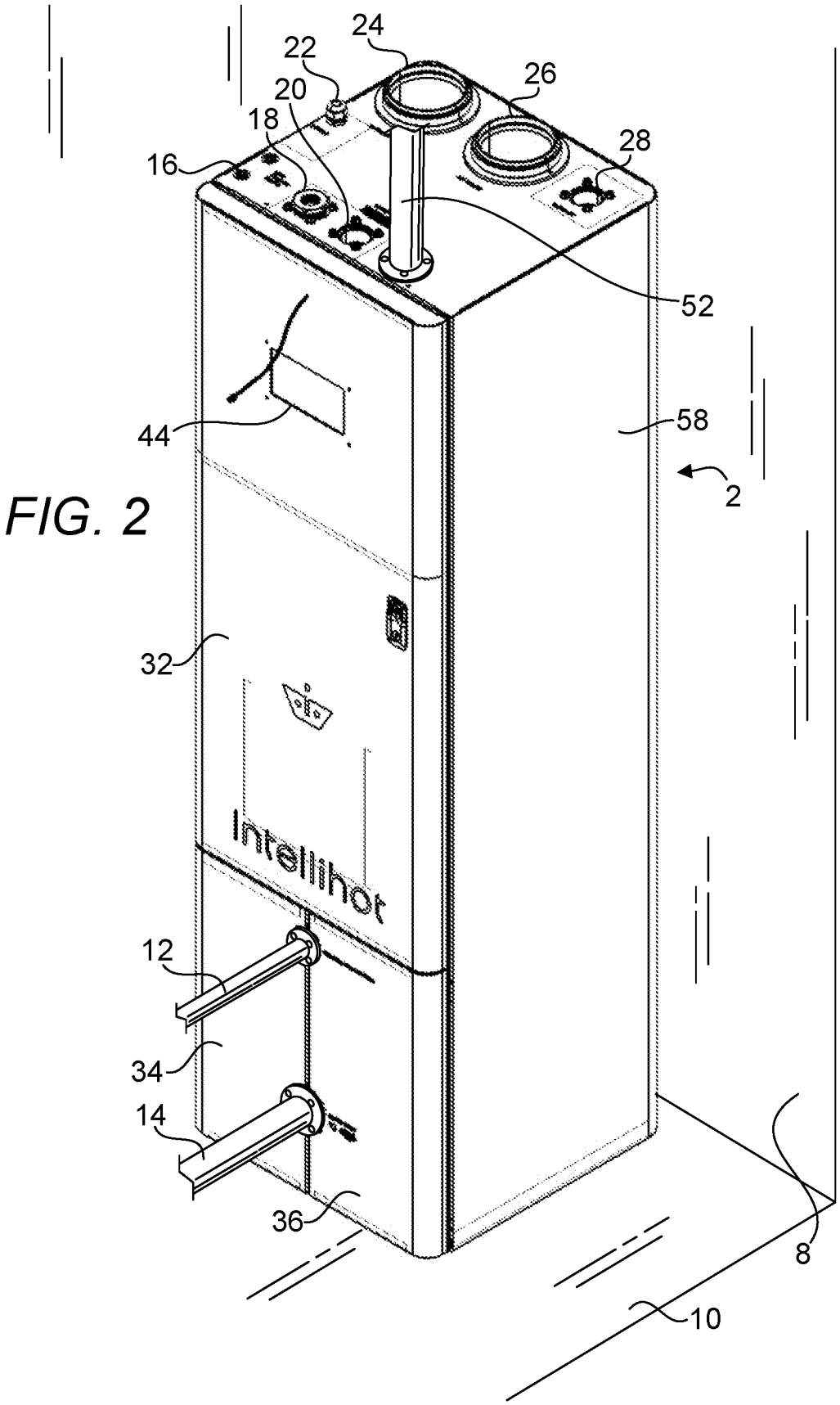
FIG. 2 is a front perspective view of an enclosure of a heating system with a water inlet and a recirculation conductor connected to the heating system.

FIG. 1 is a front perspective view of an enclosure of a heating system with an upper door 32 disposed on an upper front portion of the enclosure and a lower left door 34 and lower right 36 door, both of which can be opened allowing access from a lower front portion of the enclosure 2 of the contents of interior of the enclosure 2 even when the water inlet and recirculation connections are in place. FIG. 2 is a front perspective view of an enclosure 2 of a heating system with a water inlet conductor 14 and a recirculation conductor 12 connected to the heating system. It shall be noted, in FIG. 1, that there are two ports 4, 6 disposed on the front surface 46 of the enclosure 2. In the embodiment shown in FIG. 2, the ports 4, 6 are recirculation and inlet ports, respectively, and the water inlet conductor 14 is connected to port 6 and the recirculation conductor 12 is connected to port 4. Alternatively, a water inlet port 38 disposed on a top surface of the enclosure 2 can also be used for receiving a cold water supply. This water inlet port 38 is useful for receiving a cold water supply that extends from above the enclosure 2 via a water supply conductor 52. Front surface 46 is considered the front wall of the enclosure 2 as it is a surface which is orientated to face an installer or service personnel of the heating system or a surface through which a service personnel will gain access to the interior of the enclosure 2. Surface 46 is preferably orientated in a direction facing away from a wall 8 of the space within which the heating system is disposed as shown in FIG. 2. In the embodiment shown, the heating system is essentially a rectangular structure located as close to the wall 8 as possible to maximize the space efficiency of the space, e.g., a mechanical room, within which the heating system is disposed and supported on floor 10. A user interface 44, e.g., an Liquid Crystal Display (LCD) or a Light-Emitting Diode (LED) display functionally connected to the heating system is disposed on the upper door 32 for receiving input from or display output for the benefit of an installer or service personnel. Several ports and devices are disposed on a top surface of the enclosure, e.g., a temperature sensor 16, a relief valve port 18, a hot water outlet port 20, a power supply inlet port 22, an exhaust outlet port 24, a fresh air intake port 26, a fuel supply port 28 and a water inlet port 38.

Figure 3:
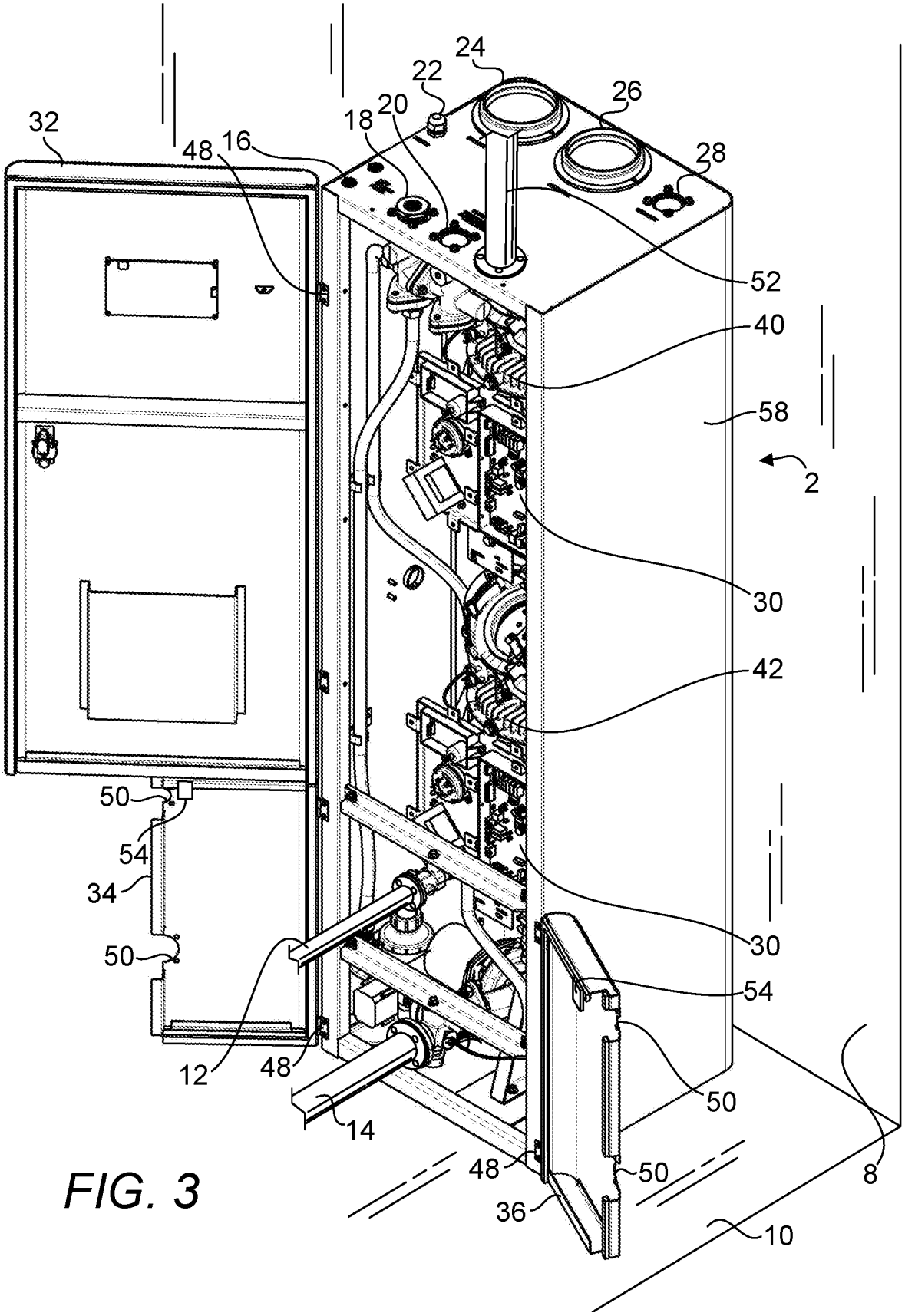
FIG. 3 is a front perspective view of an enclosure of a heating system with a water inlet and a recirculation conductor connected to the heating system and the doors of the enclosure disposed in an open position.

FIG. 3 is a front perspective view of an enclosure 2 of a heating system with a water inlet conductor 14 and a recirculation conductor 12 connected to the heating system and the doors 32, 34, 36 of the enclosure disposed in an open position. Each door is essentially rectangularly shaped and disposed in such a manner where one of its vertical edges is hinged to allow the door to rotate about at least a hinge 48 having an axis of rotation that is disposed vertically. The access afforded by doors 34, 36 allows service personnel to readily access the lower portion of the contents of the enclosure 2 and as such the availability of this access is advantageous over many existing heating system configurations where the portions of enclosures through which services are provided, e.g., cold water inlet, heated water outlet, recirculation and gas inlet, are not removable when connections for services, e.g., water and gas, etc., are in place to provide a barrier for the protection of the contents of the enclosure 2 when access to the interior of the enclosure is not required. The single upper door 32 provides access to the upper and lower heating units or heat exchangers 40, 42, control module/s or controllers 30 of the heating units as well as other components. In some applications, conductors 12 and 14 have previously been plumbed in the configurations shown. A heating system with the present enclosure can be "dropped in" directly in the space previously occupied by another device, removing the need to re-plumb suitable conductors near the floor 10 or ceiling of a space in which the heating system is located. Here, it shall be seen that a cold water supply is supplied to the heating system via a conductor 14, a heated water output is available through port 20 and a recirculation flow is routed via conductor 12. The doors 34, 36 are closed around the area surrounding the conductors 12, 14 to prevent access to the interior of the enclosure 2 to protect the contents of the enclosure 2. However, when access is required, the doors 34, 36 can be opened as shown in FIG. 3 for access to components, e.g., top heating unit 40 and bottom heating unit 42, their respective controllers 30 and other devices in the interior of the enclosure 2. The upper door 32 is also shown in an open position to allow access to the contents of the enclosure 2 disposed on the upper portion of the enclosure 2. As the doors 32, 34 and 36 are hinged or connected to other parts of the enclosure, the possibility that the access afforded by the doors 32, 34, 36 will be inadvertently left behind or lost once the access is no longer required is reduced. In one embodiment, the heating system is configured to be non-operational or turned off if any one or all of the doors 32, 34 and 36 is/are detected to be open, e.g., via switches. If access is needed while the heating system is operational, "cheaters" may be used to simulate depression of the switches that indicate the closed state of the doors such that the heating system is allowed to be operational while the doors are open, i.e., while access to the interior of the heating system is available. Cutouts 50 formed in the left and right lower doors 34, 36 are useful for accommodating the ports 4, 6 and the conductors 12, 14 while allowing the doors 34, 36 to properly isolate the interior of the enclosure 2 from the exterior environment of the enclosure 2. In the embodiment shown, the lower doors 34, 36 are secured by means of a magnetic latch 54. Access to service interfaces disclosed herein may alternatively or additionally provided on other surfaces, e.g., side 58, rear or top, etc., of the enclosure 2.

Figure 4:
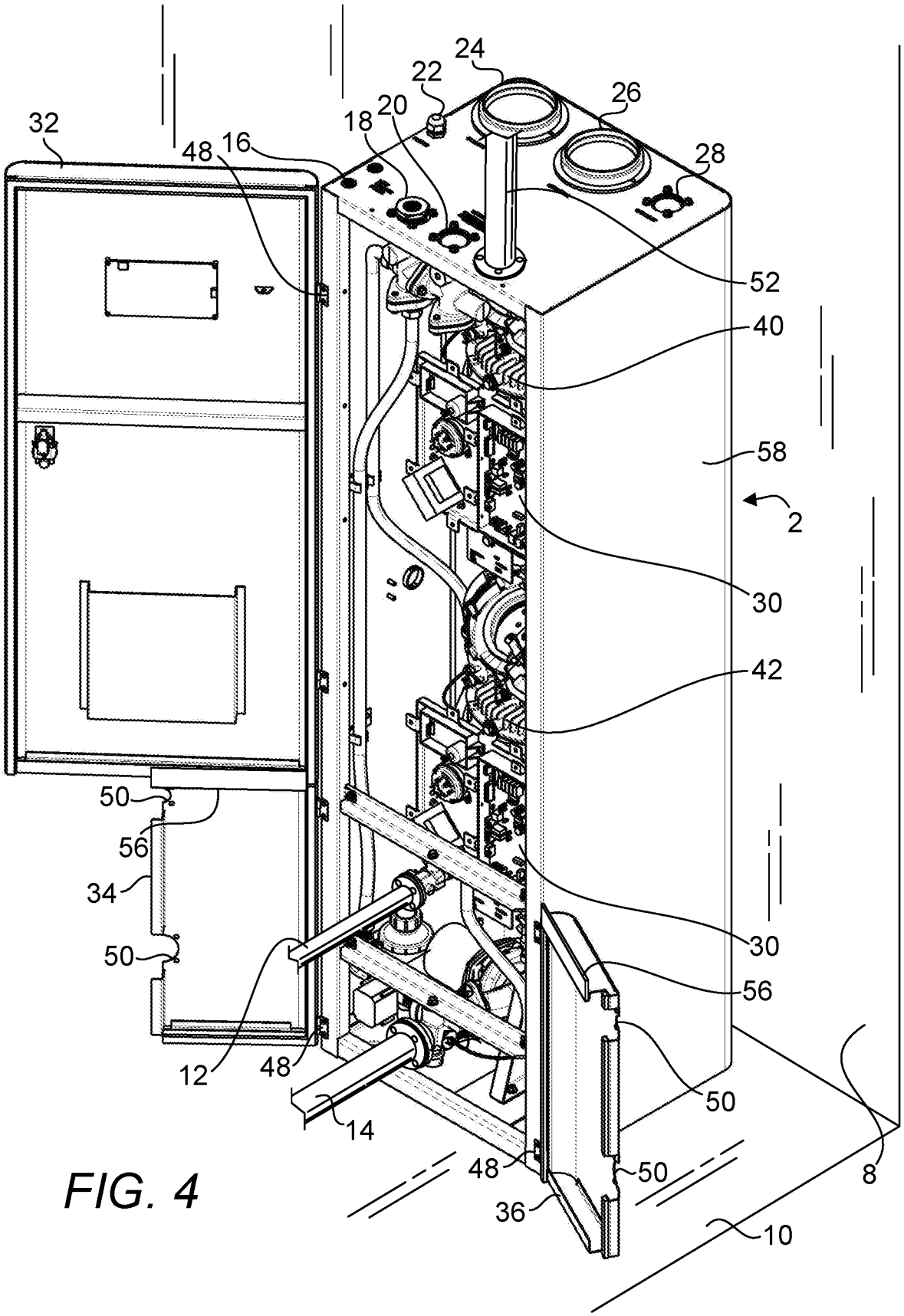
FIG. 4 is a front perspective view of an enclosure of a heating system with a water inlet and a recirculation conductor connected to the heating system and the doors of the enclosure disposed in an open position, depicting the closure of the lower doors that is secured with the upper door.
Figure 5:
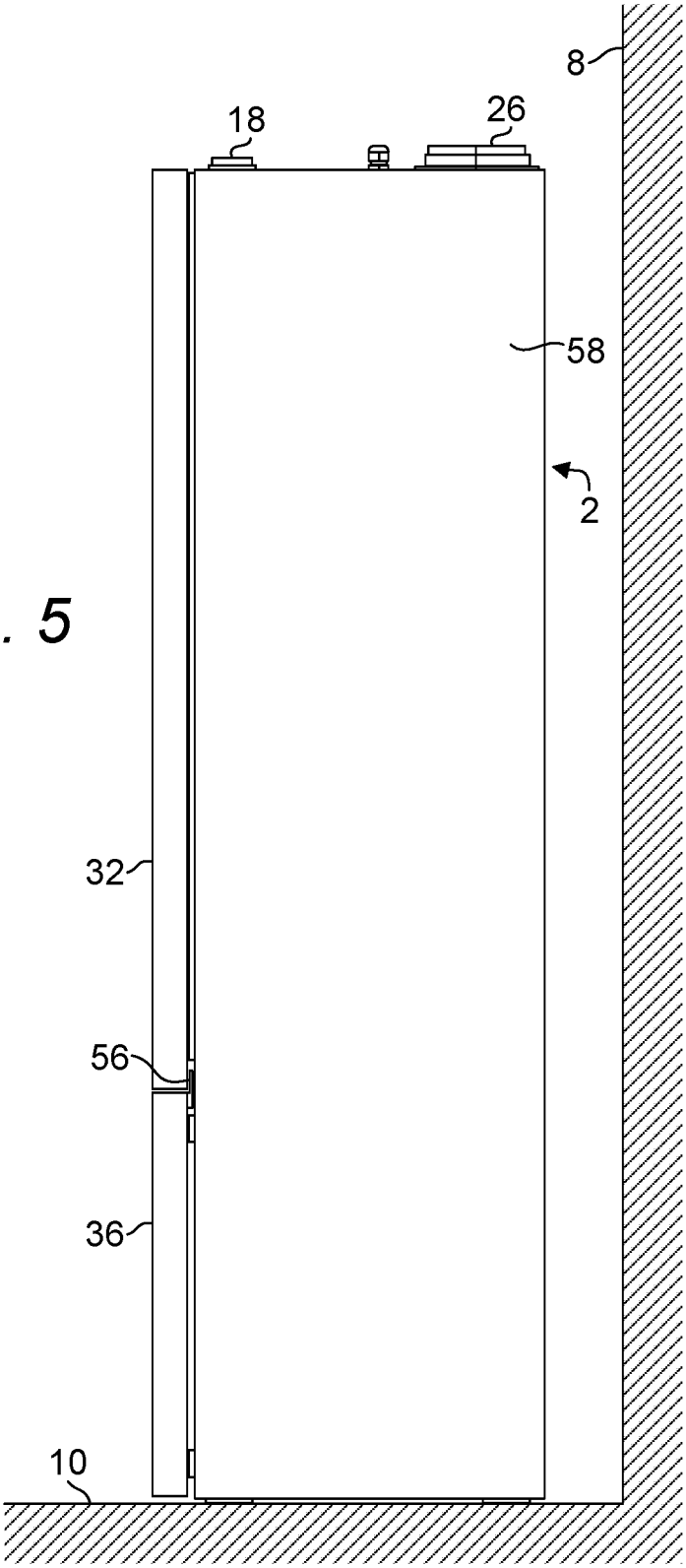
FIG. 5 is a simplified side view of the enclosure of FIG. 4, depicting the closure of the lower doors that is secured with the upper door.

FIG. 4 is a front perspective view of an enclosure of a heating system with a water inlet and a recirculation conductor connected to the heating system and the doors of the enclosure disposed in an open position, depicting the closure of the lower doors 34, 36 that is secured with the upper door 32. FIG. 5 is a simplified side view of the enclosure 2 of FIG. 4, depicting the closure of the lower doors 34, 36 that is secured with the upper door 32. It shall be noted that, in this embodiment, each of the lower doors 34, 36 includes a lip 50 extending from a rear top edge of each lower door 34, 36. In this embodiment, the lower doors 34, 36 can be opened as shown in FIGS. 3 and 4. However, in their closed position, the lower doors 34, 36 can be retained by closing the upper door 32 against the lips 56 disposed on the rear top edge of the lower doors 34, 36. Therefore, in this embodiment, the lower doors 34, 36 do not require an additional means of securement. Referring to FIG. 5, it shall be noted that in their closed position, the lower doors 34, 36 can only be opened by opening the upper door 32 first. However, the securement of the upper door 32 alone is sufficient in securing the lower doors 34, 36.

Figure 6:
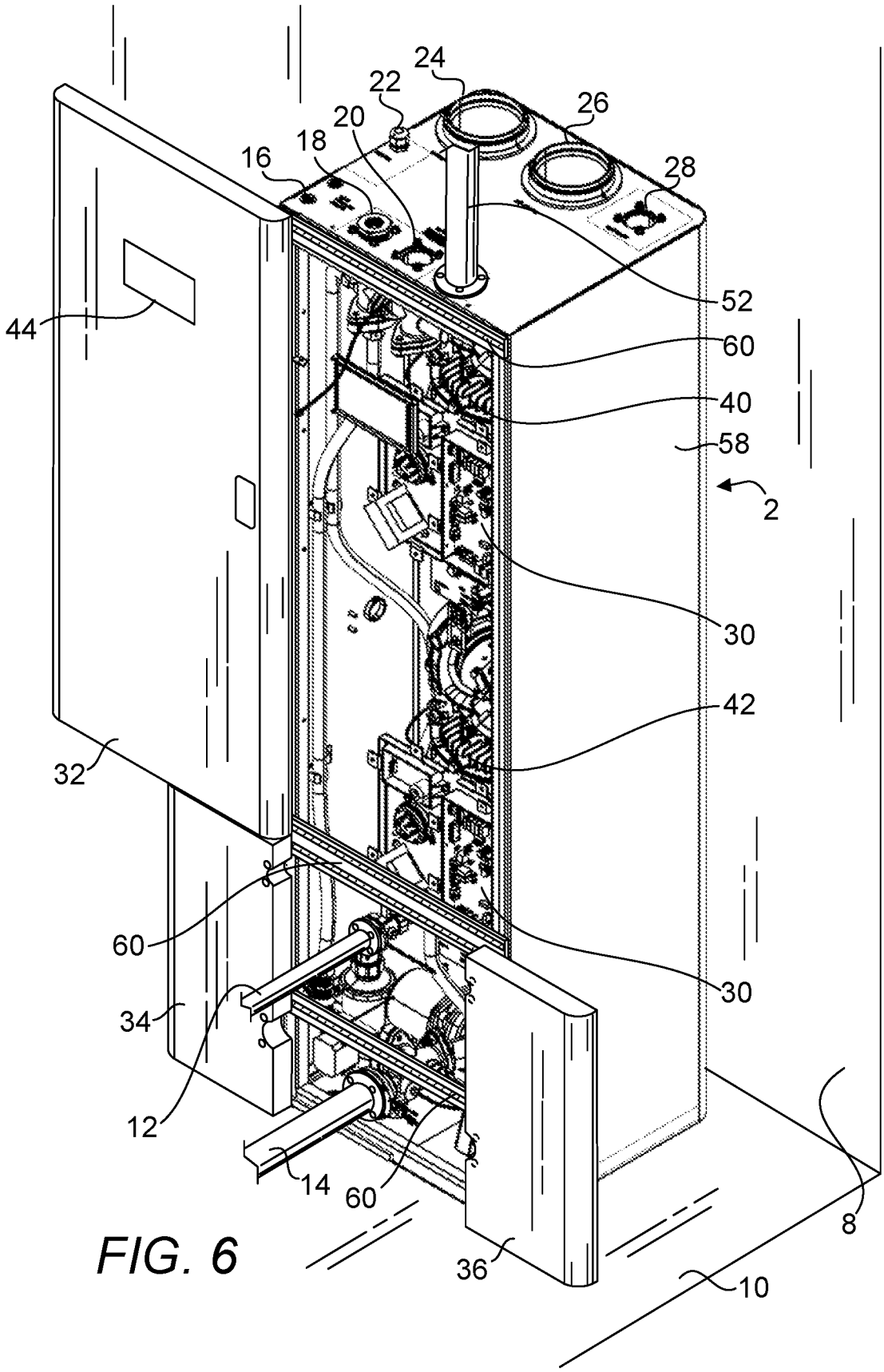
FIG. 6 is a front perspective view of an enclosure of a heating system with a water inlet and a recirculation conductor connected to the heating system and the doors of the enclosure disposed in an open position.

FIG. 6 is a front perspective view of an enclosure 2 of a heating system with a water inlet and a recirculation conductor connected to the heating system and the doors 32, 34, 36 of the enclosure 2 disposed in an open position. Here, all the doors 32, 34, 36 are functionally coupled to tracks 60 instead of hinges as those found elsewhere herein. The tracks 60 are disposed in the plane of or at an offset to the front surface 46. Therefore, any one of the doors 32, 34, 36 can be opened by sliding the door outwardly from the center of the front surface without being required to intrude into the space in front of the front surface 8 or the space away from the front end of the enclosure 2. The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. An enclosure for a heating system for a service selected from the group consisting of receiving water through a water inlet port and recirculating water through a recirculation port, said enclosure comprising a wall through which at least one of the water inlet port and the water recirculation port is disposed, said wall is configured to be removable for access to a heat exchanger disposed inside said enclosure, wherein the area around the service is accessible when said wall is removed without requiring the removal of a connection to at least one of the water inlet port and the water recirculation port and without requiring the removal of a protective plate to the heat exchanger and the heat exchanger is connected to at least one of the water inlet port and the water recirculation port, said wall is disposed on a front surface of said enclosure and said wall comprises at least one hinged door configured to be openable while the service is in use and said at least one hinged door is the only barrier separating an environment outside of said enclosure and an environment inside of said enclosure at said at least one hinged door.

2. An enclosure for a heating system for a service selected from the group consisting of receiving water through a water inlet port and recirculating water through a recirculation port, said enclosure comprising a wall through which at least one of the water inlet port and the water recirculation port is disposed, said wall is configured to be removable for access to a heat exchanger disposed inside said enclosure, wherein the area around the service is accessible when said wall is removed without requiring the removal of a connection to at least one of the water inlet port and the water recirculation port and without requiring the removal of a protective plate to the heat exchanger and the heat exchanger is connected to at least one of the water inlet port and the water recirculation port, said wall is disposed on a front surface of said enclosure, wherein said wall comprises at least one sliding door, said at least one sliding door comprising a plurality of tracks and a door configured to be functionally coupled to said plurality of tracks and said door remains coupled to said plurality of tracks when said at least one sliding door is disposed in an open position to allow access to equipment disposed inside said enclosure and said at least one sliding door is the only barrier separating an environment outside of said enclosure and an environment inside of said enclosure at said at least one sliding door.

* * * * *